US006484685B2

(12) United States Patent
Kuroda et al.

(10) Patent No.: US 6,484,685 B2
(45) Date of Patent: Nov. 26, 2002

(54) OUTBOARD ENGINE

(75) Inventors: Tatsuya Kuroda, Wako (JP); Masanori Tsubouchi, Wako (JP); Haruo Tsusaka, Wako (JP); Masaki Tsunoda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/074,845

(22) Filed: Feb. 13, 2002

(65) Prior Publication Data

US 2002/0108597 A1 Aug. 15, 2002

(30) Foreign Application Priority Data

Feb. 14, 2001 (JP) ..... 2001-037601

(51) Int. Cl.[7] ..... F01M 1/00; F02F 7/00

(52) U.S. Cl. ..... 123/195 P; 123/196 W; 440/77

(58) Field of Search ..... 123/195 P, 196 W; 440/77, 900

(56) References Cited

U.S. PATENT DOCUMENTS 5,803,036 A * 9/1998 Takahashi et al. ..... 123/179.25

FOREIGN PATENT DOCUMENTS

JP 10-231734 9/1998

* cited by examiner

*Primary Examiner*—Noah P. Kamen

(74) *Attorney, Agent, or Firm*—Carrier, Blackman & Associates, P.C.; Joseph P. Carrier; William D. Blackman

(57) ABSTRACT

An outboard engine comprises an engine having a crankshaft (36) extending vertically, a flywheel 56 provided on the crankshaft (36) below the engine body, an oil pump (58), and a flywheel chamber (59) defined by a pump body (65) of the oil pump (58) united to coupling walls 61, 62 of the engine body to accommodate the flywheel 56; and a mount case (4) having a support wall 64 for uniting the engine body. The engine body is united with its coupling walls (61, 62) to the support wall (64) via an outer circumferential wall (63) of the pump body (65) such that the coupling walls (61, 62), outer circumferential wall (63) and support wall (64) overlap in the direction of a rotation axis of the crankshaft (36). Such outboard engine permits a connecting portion between the engine body and the mount case, which are united together via the oil pump body, to be decreased in size and weight.

10 Claims, 10 Drawing Sheets

(A)

(B)

OUTBOARD ENGINE

BACKGROUND OF THE INVENTION

1. Field of the Invention

This invention relates to an outboard engine in which a flywheel chamber for accommodating a flywheel located below an engine body of an engine is made up of a pump body of an oil pump.

2. Description of the Related Art

There is a known outboard engine in which a flywheel driven by a crankshaft of an engine is disposed under the engine body between its bottom and amount case. For example, in an out board engine disclosed by Japanese Patent Laid-Open Publication No. hei 10-231734, a cylinder block and a crankcase forming the engine body of an engine having a vertically extending crankshaft is united with its coupling portion at a lower end portion thereof to a support portion formed as apart of amount case. The fly wheel provide data lower end portion of the crankshaft is positioned below the engine body, and an oil pump is positioned below it. The flywheel is accommodated in a flywheel chamber made up of the pump body of the oil. pump united to a lower end portion of the engine body, and the coupling portion of the engine body and the support portion of the mount case are united together to surround the pump body from radially outward thereof.

In the prior art technique, a gap in the radial direction is formed in a radial space from the pump body to the coupling portion of the engine body and the support portion of the mount case along the entire circumference. Therefore, the coupling portion and the support portion inevitably increase in outer diameter and weight, and a cover covering the engine and the mount case becomes large. As a result, the outboard engine becomes bulky and heavy.

The present invention has been made under the circumstances, and its main object is to provide a compact, lightweight outboard engine by reducing the size and weight of the connecting portion between the engine body and the mount case that are united together via the pump body of the oil pump. Another object of the invention is to provide an enhanced support strength of the engine body.

SUMMARY OF THE INVENTION

According to the invention, there is provided an outboard engine including: an engine having an engine body, a crankshaft extending vertically in the engine body, a flywheel provided on the crankshaft below the engine body, an oil pump driven by a driving power of the crankshaft, and a flywheel chamber defined by a pump body of the oil pump to accommodate the flywheel; and amount case having a support portion for uniting the engine body, characterized in that: the engine body is united with a coupling portion thereof to the support portion via an outer circumferential portion of the pump body such that the coupling portion, the outer circumferential portion of the pump body and the support portion overlap in the direction of extension of a rotating axis of the crankshaft.

According to the invention, since the coupling portion of the engine body, outer circumferential portion of the pump body and support portion of the mount case are united together such that they overlap in the direction of the rotation axis of the crankshaft, it is not necessary to provide the coupling portion and the support portion so as to surround the pump body from radially outward, and outer diameters of the coupling portion and the support portion can be minimized within a range sufficient for the pump body forming the flywheel chamber to accommodate the flywheel.

In addition to that, since the mount case is disposed such that the outer circumferential wall of the pump body overlaps the coupling portion and the support portion in the rotation axis direction, regardless of the coupling portion being united to and supported by the support portion via the pump body, weight of the engine acting upon the outer circumferential portion via the coupling portion is withheld by the support portion of the mount case via the outer circumferential portion, and it is prevented that a bending moment caused by the weight acts on the pump body.

As a result, the following effects are produced. That is, since the engine body is united, with its coupling portion for uniting the pump body defining the flywheel chamber, to the support portion of the mount case via the circumferential portion of the pump body, outer diameters of the coupling portion as the connecting portion between the engine body and the mount case, and of the outer circumferential portion and the support portion, can be minimized and decreased in weight within a range sufficient for the pump body to accommodate the flywheel, and therefore, the outboard engine can be decreased in size and weight. At the same time, since the weight of the engine acting upon the outer circumferential portion of the pump body through the coupling portion is withheld by the support portion of the mount case, it is prevented that a bending moment caused by the weight deforms the pump body. And, since the pump body need not be increased in rigidity to prevent such deformation, this also contributes to decreasing the weight of the pump body and hence the weight of the outboard engine.

The outboard engine may be mounted to a boat stern by a mounting device having a swivel shaft, and the outer circumferential portion may form a circumferential wall of the flywheel chamber. The circumferential wall may have single-wall portions, and a left wall portion and a right wall portion of the circumferential wall may be made of the single-wall portions. Outer diameters of the coupling portion and the support portion in the right and left direction may be substantially equal to the outer diameter of the circumferential wall in the left and right direction as regulated by the left wall portion and the right wall portion.

In this manner, the left wall portion and the right wall portion of the circumferential wall of the flywheel chamber defined by the outer circumferential portion of the pump body are made of singular walls, i.e. single-layered walls in the radial direction of the flywheel, and at the same time, outer diameters of the coupling portion and the support portion in the right and left direction are substantially equal to the outer diameter of the circumferential wall in the right and left direction as defined by the left wall portion and the right wall portion. Therefore, outer diameters of the coupling portion, outer circumferential portion and support portion in the right and left direction can be limited to small values based on minimum values necessary for making the circumferential wall of the flywheel chamber.

As a result, the following effects are produced. That is, since outer diameters of the coupling portion, outer circumferential portion and support portion in the right and left direction can be minimized within a range sufficient for the pump body defining the flywheel chamber to accommodate the flywheel, the cover covering the connecting portion made up of those portions can be decreased in size in the right and left direction, and it is prevented that the outboard engine interferes with other external members in the right and left direction of the connecting portion during right and left rotation of the outboard engine about the swivel shaft. This is effective for increasing the right and left rotatable range of the outboard engine upon steering and for improving the steering efficiency.

The circumferential wall may also include double-wall portions, and a front wall portion and a rear wall portion of the circumferential wall may be made of said double-wall portions. Additionally, outer diameters of the coupling portion and the support portion in the front and rear direction may be substantially equal to the outer diameter of the circumferential wall in the front and rear direction as regulated by the front wall portion and the rear wall portion.

Since the front wall portion and the rear wall portion of the circumferential wall made of the outer circumferential portion of the pump body are made of double-wall portions, i.e. double walls distant in the radial direction of the flywheel, and outer diameters of the coupling portion and the support portion in the front and rear direction are substantially equal to the outer diameter of the circumferential wall in the front and rear direction as regulated by the front wall portion and the rear wall portion, the support strength is enhanced, and the region of the engine body supported by the support portion increases.

As a result, the following effects are produced. That is, the structure configuring the front wall portion and the rear wall portion of the circumferential wall defined by the outer circumferential portion of the pump body to be double-wall portions and substantially equalizing outer diameters of the coupling portion and the support portion in the front and rear direction to the outer diameter of the circumferential wall in the front and rear direction, regardless of the outer diameter of the support portion being small in the right and left direction, the support strength is enhanced, a sufficient support strength of the engine body is ensured, and the region of the engine body supported by the support portion increases. Thus the engine body can be supported more reliably.

DESCRIPTION OF THE PREFERRED EMBODIMENTS

Embodiments of the invention will now be explained below with reference to FIGS. 1 through 11. In the following explanation, directions or portions such as front, rear, left, right, etc. are used with respect to those of the boat's stern on which the outboard engine is borne.

Figure 1:
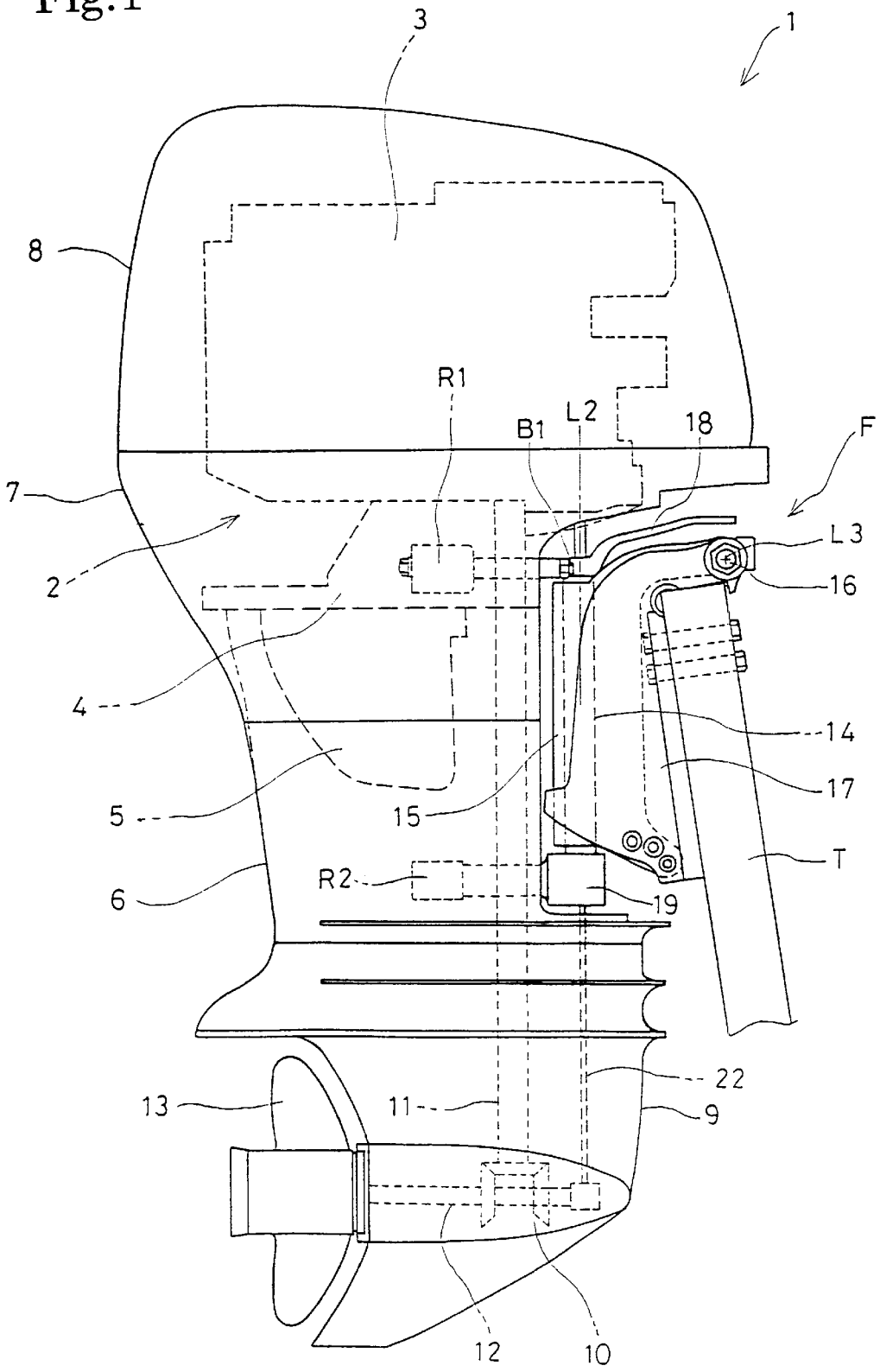
FIG. 1 is a schematic right side elevational view of an outboard engine according to an embodiment of the invention.
Figure 2:
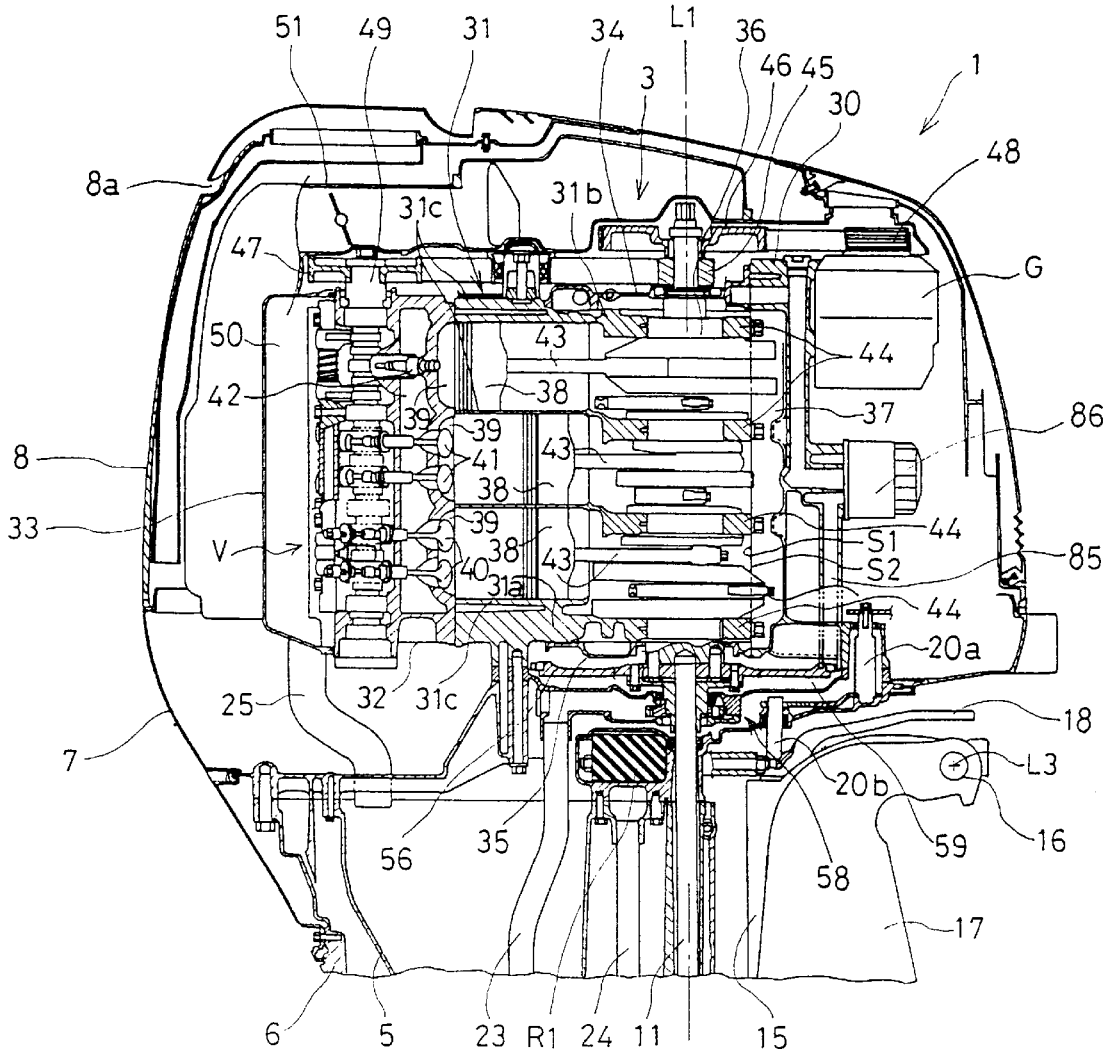
FIG. 2 is a fragmentary cross-sectional view of the outboard engine of FIG. 1, taken along a vertical plane approximately including the rotating axis of the crankshaft and the center axis of the left bank cylinder.

Referring to FIG. 1, which is a schematic right side elevational view of the outboard engine 1 according to an embodiment of the invention, the outboard 1 includes an engine 2 having a crankshaft 36 extending vertically (see FIG. 2). The engine body 3 of the engine 2 is supported on a mount case 4. United to a lower end portion of the mount case 4 are an oil pan 5 and an extension case 6 covering members extending downward from the engine body 3 including the oil pan 5. United to an upper end portion of the extension case 6 is an under cover 7 to define an engine room for accommodating the engine body 3. To a lower end portion of the extension case 6, a gear case 9 is united, which accommodates a headway/sternway switching device 10.

A drive shaft 11 coupled to the crankshaft 36 for integral rotation therewith extends downward through the extension case 6 into the gear case 9, and a lower end portion of the drive shaft 11 is coupled to a propeller shaft 12 having propellers 36 via the headway/sternway switching device 10. Therefore, driving power of the engine 2 is transmitted to the propellers 13 through the crankshaft 36, drive shaft 11, headway/sternway switching device 10 and propeller shaft 12, and rotates the propeller 13.

Figure 3:
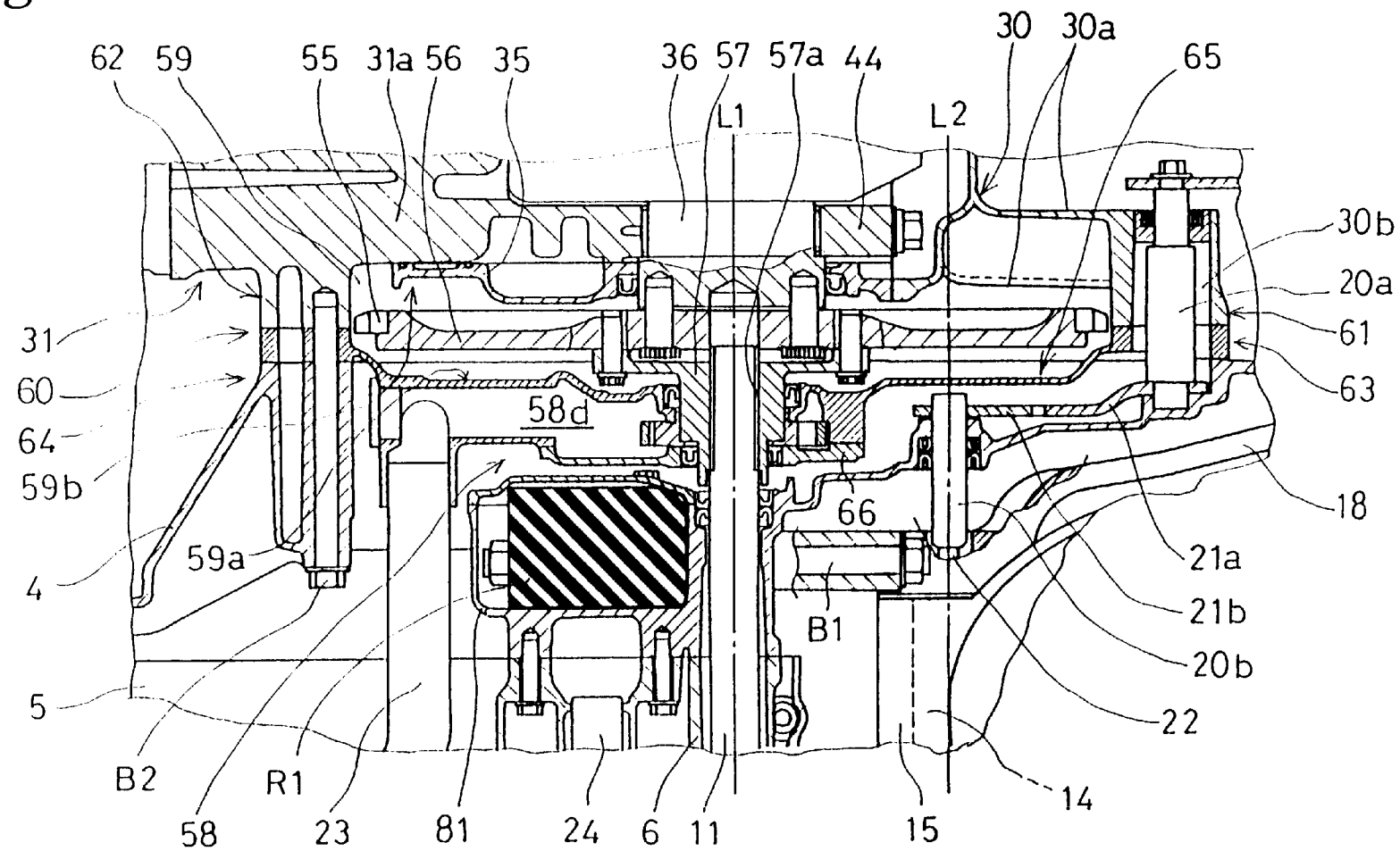
FIG. 3 is a fragmentary enlarged view of FIG. 2.

Referring to FIGS. 1–3 in combination, the outboard engine 1 is mounted to the boat's stern by a mounting device F. The mounting device includes a swivel shaft 14, swivel case 15 pivotally supporting the swivel shaft 14, horizontal tilt shaft 16 pivotally supporting the swivel case 15, and stern bracket 17 affixed with the tilt shaft 16 at an upper end portion and fixed to the read end of the stern T. The swivel shaft 14 is formed integrally with a mount frame 18, and it is secured, at its upper end portion, to the mount case 4 through mount rubber R1 with a pair of stud bolts B1 fixed to the mount frame 18. Additionally, the swivel shaft 14 is fixed'secured to the extension case 6 through mount rubber R2 with a pair of stud bolts (not shown) fixed to a housing 19 in spline coupling with a lower portion of the swivel shaft 14.

The mounting device F permits the outboard engine 1 to swing right end left about the pivotal axis, which is the center axis 12 of the swivel shaft 14, and to swing up and down about the pivotal axis, which is the horizontal center axis L3 of the tilt shaft 16. As to operation of a shift manipulator for switching forward and backward movement of the boat stern T, as shown in FIGS. 2 and 3, a shift rod 22 passing inside the cylindrical swivel shaft 14 is rotated through a pair of shifting shafts 20*a*, 20*b* interlinked via a pair of segment gears 21*a*, 21*b* in engagement with each other, and based on the rotation of the shift rod 22, the headway/sternway switching device 10 changes headway and sternway movements of boat stern T.

Figure 4:
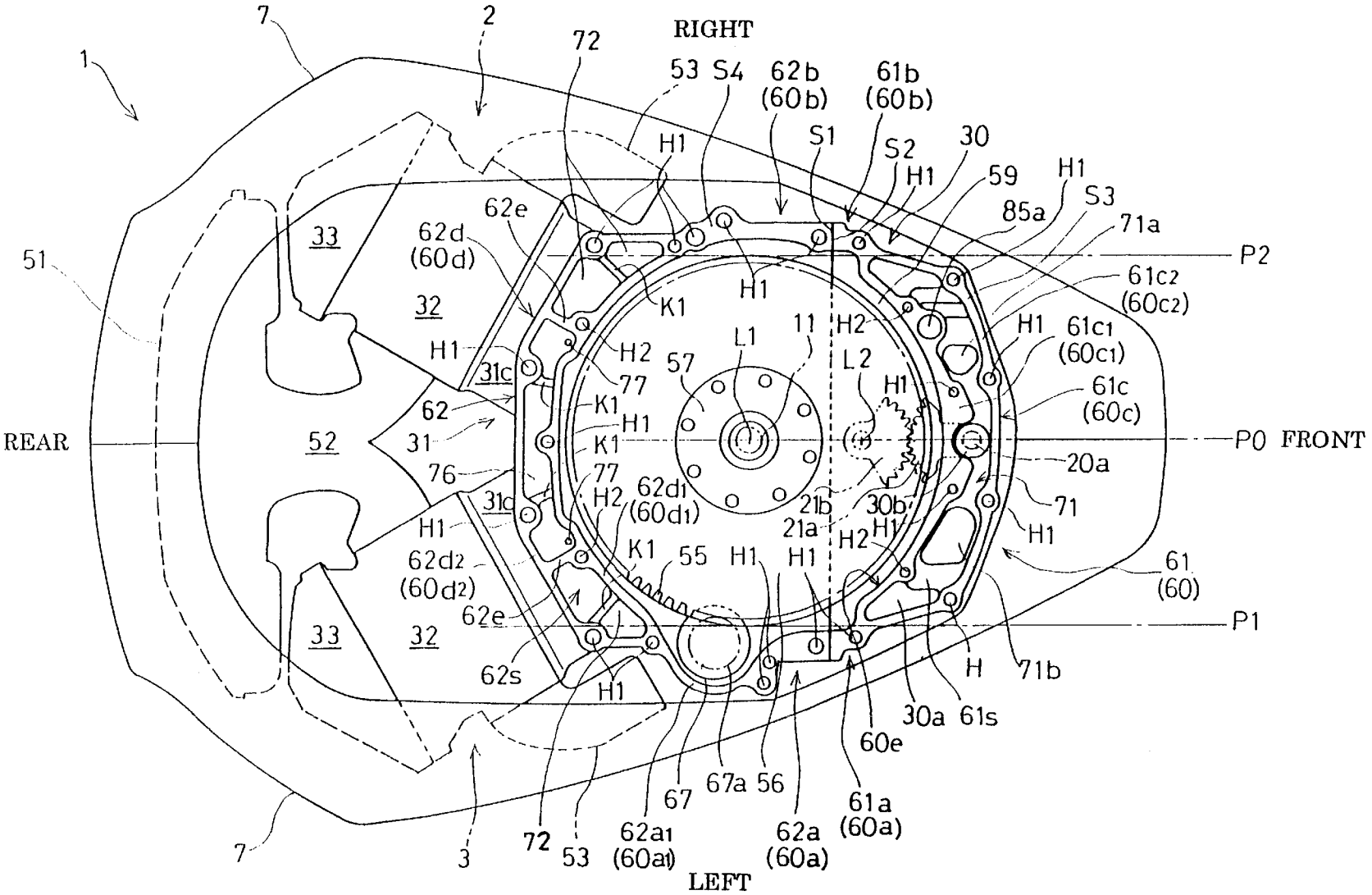
FIG. 4 is a bottom view of a crankcase and a cylinder block of an engine of the outboard engine of FIG. 1.

Referring to FIGS. 2 and 4, further explanation is made about the engine. The engine 2 is a V-type six-cylinder water-cooled SOHC four-stroke cycle internal combustion engine, and its engine body 3 is made up of a crankcase 30, which forms the front portion of the engine body 3, cylinder block 31, cylinder heads 32 of respective banks, head cover 33, upper seal cover 34, and lower seal cover 35. These crankcase 30, cylinder block 31, cylinder head 32 and head cover 33 are assembled in this order from headway to sternway of the boat stern T.

A pair of banks of the cylinder block 31 has a V configuration opening backward when viewed in a plan view (see FIG. 4). Each bank is made up of three cylinders 31 caligned vertically along the crankshaft 36. The cylinder block 31 is a so-called deep skirt type cylinder block in which right and left wall portions constitute skirt portions extending forward beyond the rotation axis L1 of the crankshaft 36 and a fitting surface S2 for close contact with a fitting surface S1 of the crankcase 30 is positioned forward of the rotation axis L1. Therefore, the upper seal cover 34 and the lower seal cover 35 having holes permitting the crankshaft 36 to liquid-tightly pass through are joined to the upper wall 31*b* and the lower wall 31*a* of the cylinder blocks 31 by applying bolts to the cylinder block 31 and the crankcase 30 to cooperate with the front portion of the cylinder block 31, skirt portion and crankcase 30 to define a crank chamber 37, and the fitting surfaces of both seal covers 34, 35 with the crankcase 30 lie on the common plane to that of the fitting surface S2. Then the bottom wall of the crank chamber 37 is made up of the lower seal cover 35 and the bottom wall of the crankcase 30.

In association of the cylinder head 32 of each bank, there are provided a pair of intake valves 40 for opening or closing a pair of intake openings, which open into a combustion chamber 39 defined between the cylinder head 32, and a piston 38 slidably fitting in each cylinder 31*c*, and a pair of exhaust valves 41 for opening or closing a pair of exhaust openings, which open into the combustion chamber 39. A sparkplug is also attached to the cylinder head 32 to orient the center of the combustion chamber 39. The piston 38 is connected to the crankshaft 36 via a connection rod 43, and the crankshaft 36 is driven for rotation movements by the reciprocating piston 38. Four journals of the crankshaft 36 are supported individually by the cylinder block 31 and a bearing cap 44 attached to the cylinder block 31, via a plane bearing. In this manner, the crankshaft 36 can rotate relative to the cylinder block 31.

To the top end of the crankshaft 36 projecting upward from the upper seal cover 34, a first drive pulley 45 is coupled, and a second drive pulley 46 thereon. A timing belt is provided to wrap the first drive pulley 45 and a first idler pulley 47 coupled to an upper end portion of a cam shaft 49 rotatably supported by the cylinder head 32 of each bank to extend vertically, such that the cam shafts 49 of both banks are driven to rotate at a half revolution of the crankshaft 36. Thus the valve drive mechanism V made up of the cam shaft 49, intake and exhaust cams formed on the cam shaft 49, intake rocker arm and exhaust rocker arm contacting with and swung by the those cams to open or close an intake valve 40 or exhaust valve 41, respectively, is disposed in a valve drive chamber 50 defined by the cylinder head 32 and the head cover 33. On the other hand, a drive belt is provided to wrap the second drive pulley 46 and a second idler pulley 48 coupled to an upper end portion of the rotating shaft of an alternating current generator G, and the rotating shaft is driven to rotate by the crankshaft 36

At the other end of each intake port having formed a pair of intake openings at one end, the downstream end of an intake manifold 52 (see FIG. 4) having formed a fuel injection valve is connected, and air for combustion is supplied to the combustion chamber 39 together with a fuel injected from the fuel injection valve through the intake device made up of an intake duct 51 having a throttle valve connected to an air intake opening 8*a* of the engine cover 8 and the intake manifold 52 and through an intake port. On the other hand, at the other end of each exhaust port having a pair of exhaust openings at one end, the upstream end of the exhaust manifold 53 is connected, and combustion gas from each combustion chamber 39 is discharged from the exhaust opening into water through an exhaust port, an exhaust device made up of an exhaust manifold 53 and exhaust tube 54 (see FIG. 8), and through the extension case 6 and the gear case 9.

On the other hand, as best shown in FIG. 3 that is an enlarged view of a lower end portion of the engine body 3, at the bottom end of the crankshaft 36 projecting downward from the lower seal cover 35, a flywheel 56 having formed a ring gear along the circumference thereof is united with bolts. To the bottom surface of the flywheel 56, a cylindrical spline piece 57 is coupled, and the upper end of the drive shaft 11 is in spline coupling with the spline piece 57 in its inner hole 57*a*, such that the drive shaft 11 rotates integrally with the crankshaft 36. At a location below the flywheel 56, a trochoid type oil pump 58 is provided, which is rotated by the driving power of the crankshaft 36.

Referring to, in particular, FIG. 3 and FIGS. 5 and 7(A) in combination, the flywheel 56, located below the engine body 3, is held in a flywheel chamber 59 defined by coupling a pump body 65 to the cylinder block 31 and the crankcase 30 with bolts (not shown). The flywheel chamber 59 includes a bottom wall 59*a* and an upper wall 59*b* opposing in the rotation axis direction (which is the direction in which the rotating axis L1 of the crankshaft 36 extends, and is simply referred to as the rotation axis direction hereunder), and a circumferential wall 60 located radially outward of the flywheel 56. The upper wall 59*b* is made up of the lower wall 31*a* of the cylinder block 31, lower seal cover 35 and bottom wall 30*a* of the crankcase 30. The lower wall 59*a* is made up of the pump body 65, and the circumferential wall 60 is made up of a coupling wall 61, which is a projecting wall downwardly projecting from the lower surface of the bottom wall 30*a* of the crankcase 30, a coupling wall 62, which is a projecting wall downwardly projecting from the lower surface of the lower wall 31*a* of the cylinder block 31 while surrounding the lower seal cover 35 from radially outside, and an outer circumferential wall 63 of the pump body 65.

As shown in FIG. 4, particularly, the circumferential wall 60 is a plane parallel to a reference plane P0 including the rotating axis L1 and perpendicular to the center axis L3 of the tilt shaft 16 (which reference plane P0 is a plane including the rotating axis L1 and the center axis L2 of the swivel shaft 14 as well), and with reference to a first plane P1 where its left side contacts the flywheel 56 and a second plane P2 where its right side contacts the flywheel 56, it includes a left wall portion 60*a* positioned leftward of the first plane P1, a right wall portion 60*b* positioned rightward of the second plane, a front wall portion 60*c* positioned forward between the first and second planes P1, P2, and a rear wall portion 60*d* positioned rearward between them.

Figure 5:
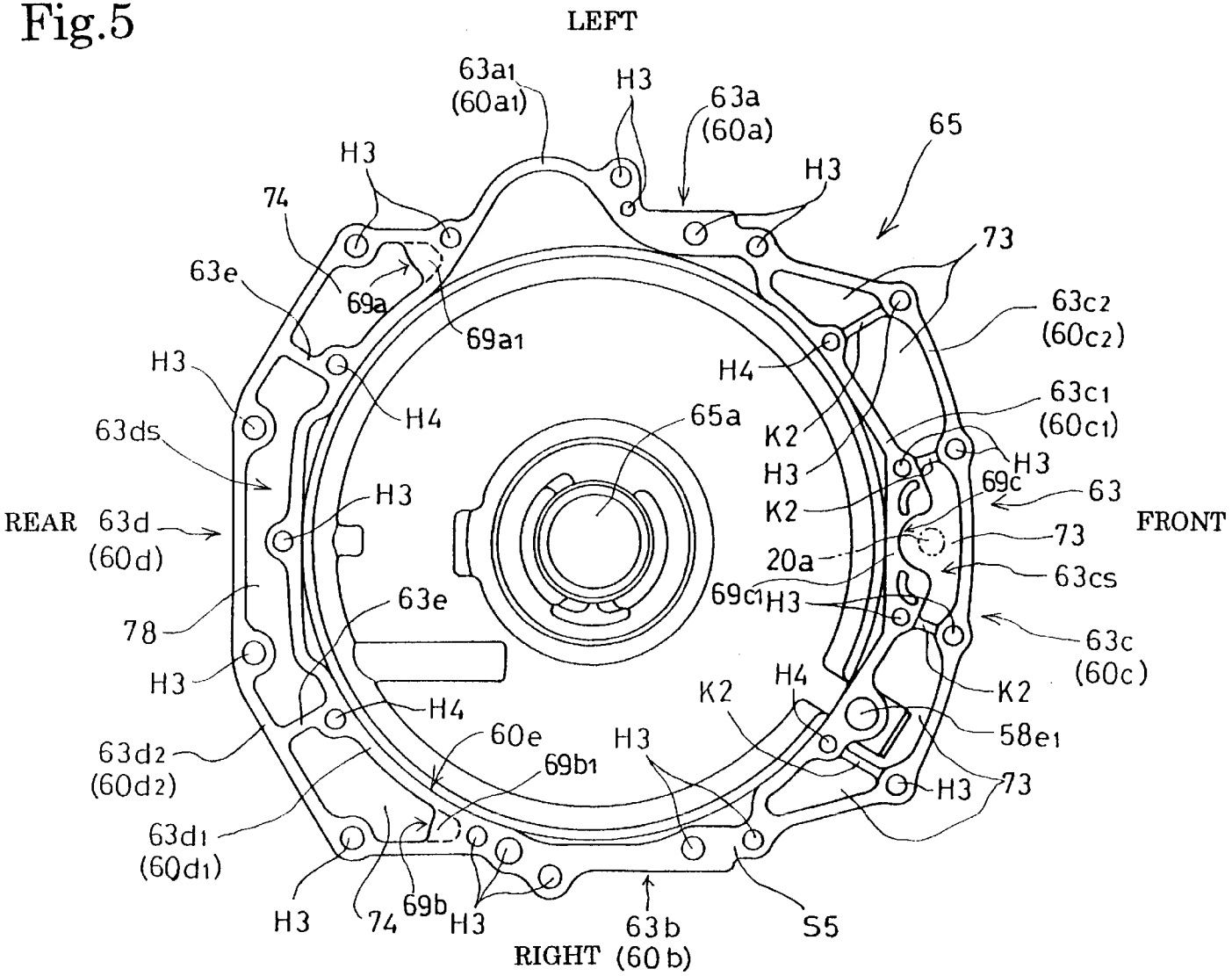
FIG. 5 is a top plane view of the pump body of an oil pump.

As shown in FIGS. 4, 5 and 7(A), the left wall portion 60*a* and the right wall portion 60*b*, which each are made of a single wall in the radial direction of the flywheel 56, are single-wall portions of the circumferential wall 60, and the front wall portion 60*c* and the rear wall portion 60*d*, which each are made up of double walls, namely, inner walls 60*c*1, 60*d*1 and outer walls 60*c*2, 60*d*2 separated by a distance in the radial direction of the flywheel 56, are double-wall portions of the circumferential wall 60. Then, the left wall portion 60*a*, right wall portion 60*b*, front wall portion inner wall 60*c*1 and rear wall portion inner wall 60*d*1 make up the inner circumferential wall forming an approximately circular inner circumferential wall surface 60*e* of the fly wheel chamber 59 having the rotating axis L1 as its center in its plan view.

As shown in FIGS. 5 through 7(A), the oil pump 58 includes a pump body 65 having a hole 65*a* liquid-tightly receiving the drive shaft 11 therethrough, and a pump cover 66 fixed on the lower surface of the pump body 65 by threading engagement. The oil pump 58 further includes an inner rotor 58*a* coupled to the spline piece 57 for integral rotation such that the crankshaft 36 functions as the pump drive shaft, and an outer rotor 58*b* that rotates in sliding contact with the inner rotor 58*a*. Both rotors 58*a*, 58*b* are located in a rotor accommodating chamber defined by the pump body 65 and the pump cover 66, and a plurality of pump chambers 58*c* each with a space variable in volume are made between the rotors 58*a*, 58*b*.

Figure 6:
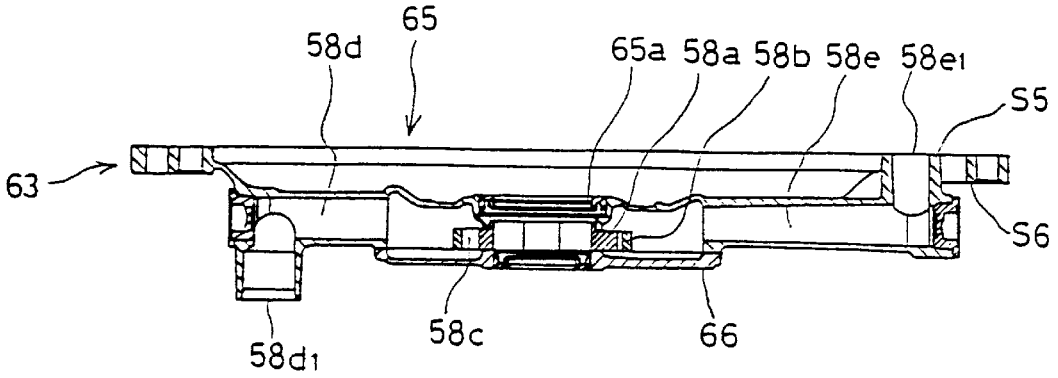
FIG. 6 is a cross-sectional view taken along the VI—VI line of FIG. 7(A)
Figure 7:
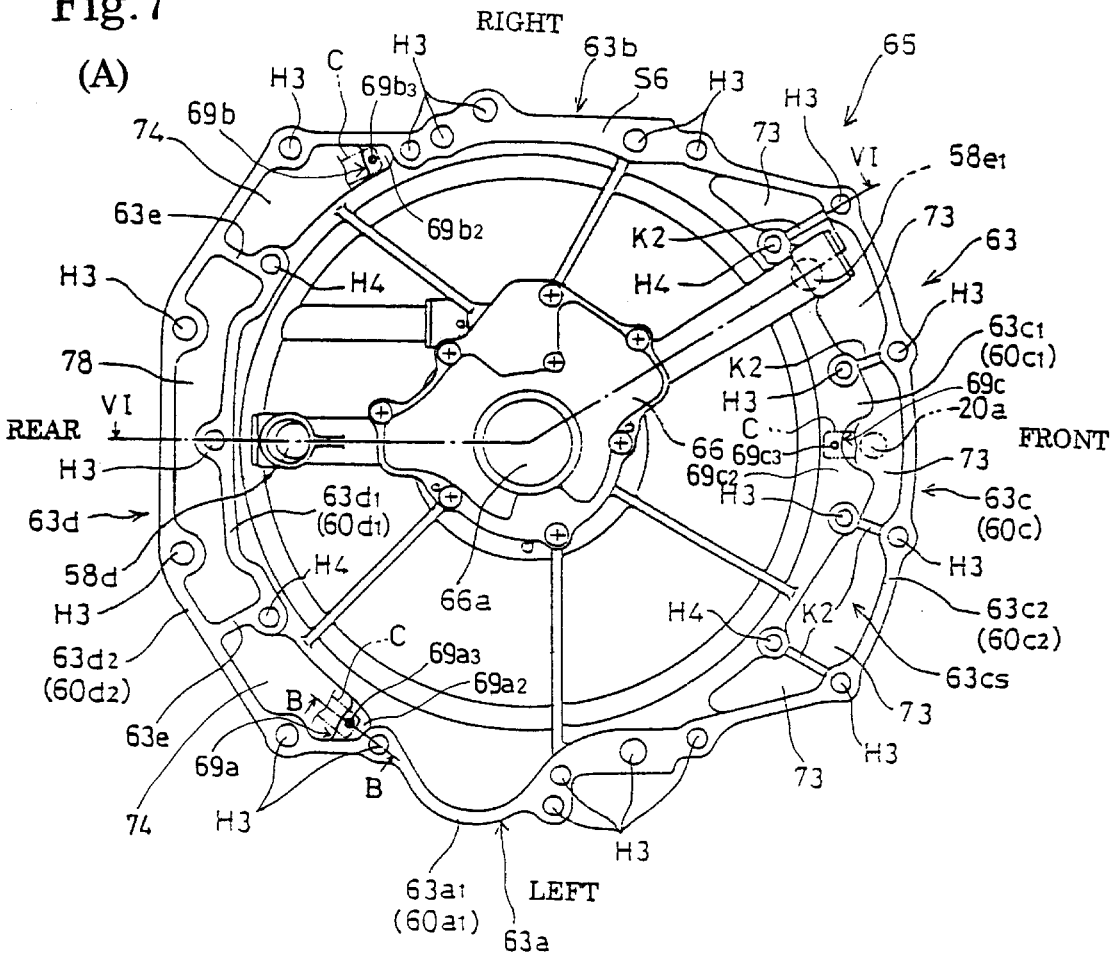
FIG. 7(A) is a bottom view of a pump body of an oil pump.
FIG. 7(B) is a sectional view taken along the B—B line of FIG. 7(A)
Figure 7:
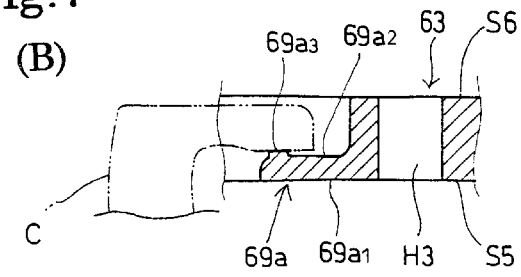

Further referring to FIG. 6, the pump body 65 has formed a suction port 58*d* and a release port 58*e*. Connected to the inlet opening 58*d*1 of the suction port 58*d* is the upper end of an oil suction tube 23 extending downward inside the oil pan 5 located below the flywheel 56. The outlet opening 58*e*1 of the release port 58*e* opens at a fitting surface S5 of the outer circumferential wall 63, and it is connected to the inlet opening 85*a* of the case oil path 85 opening at a fitting surface S3 of the crankcase 30, which will be explained later (see FIG. 4).

Figure 8:
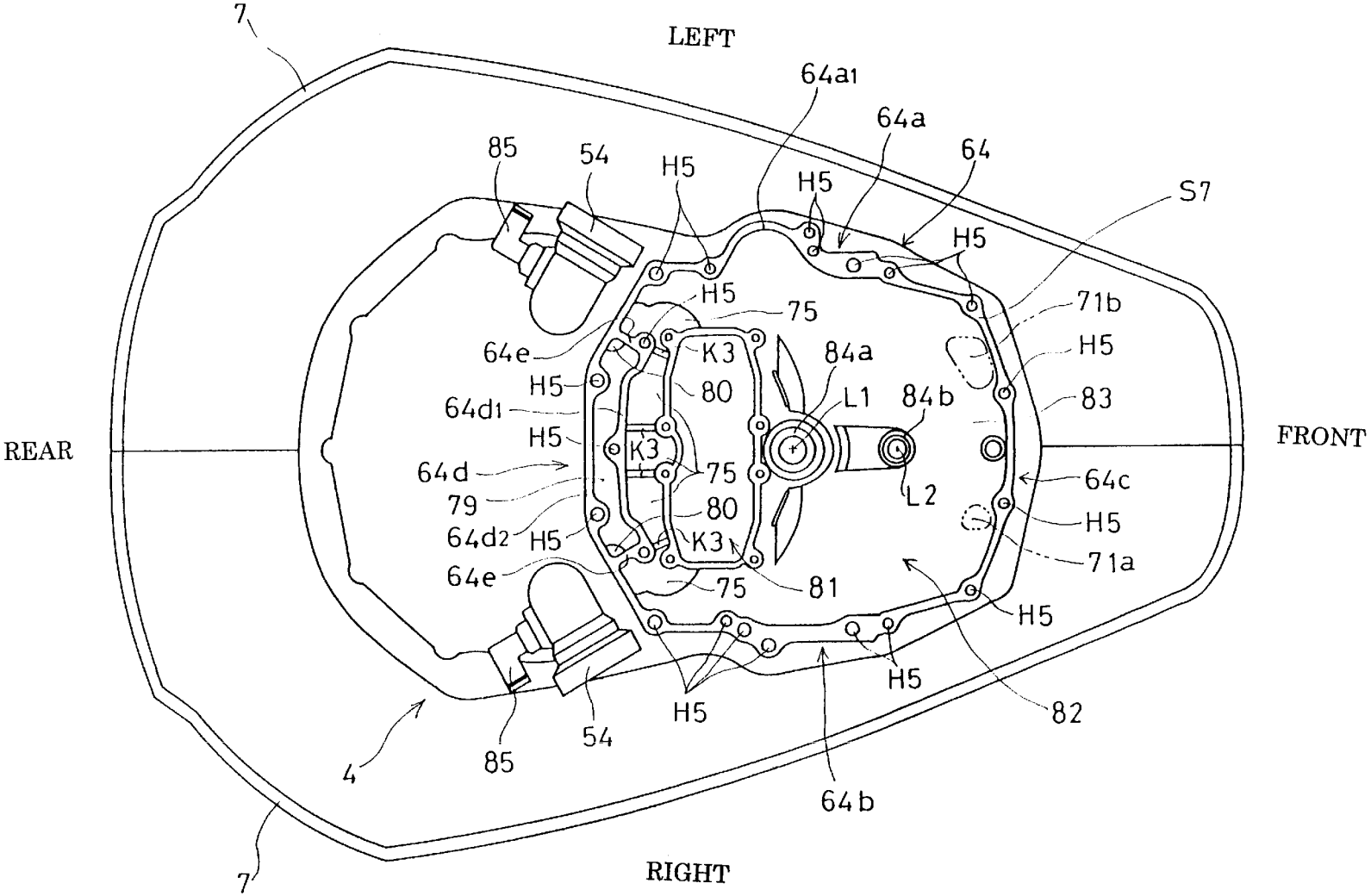
FIG. 8 is a top plane view of a mount case.
Figure 9:
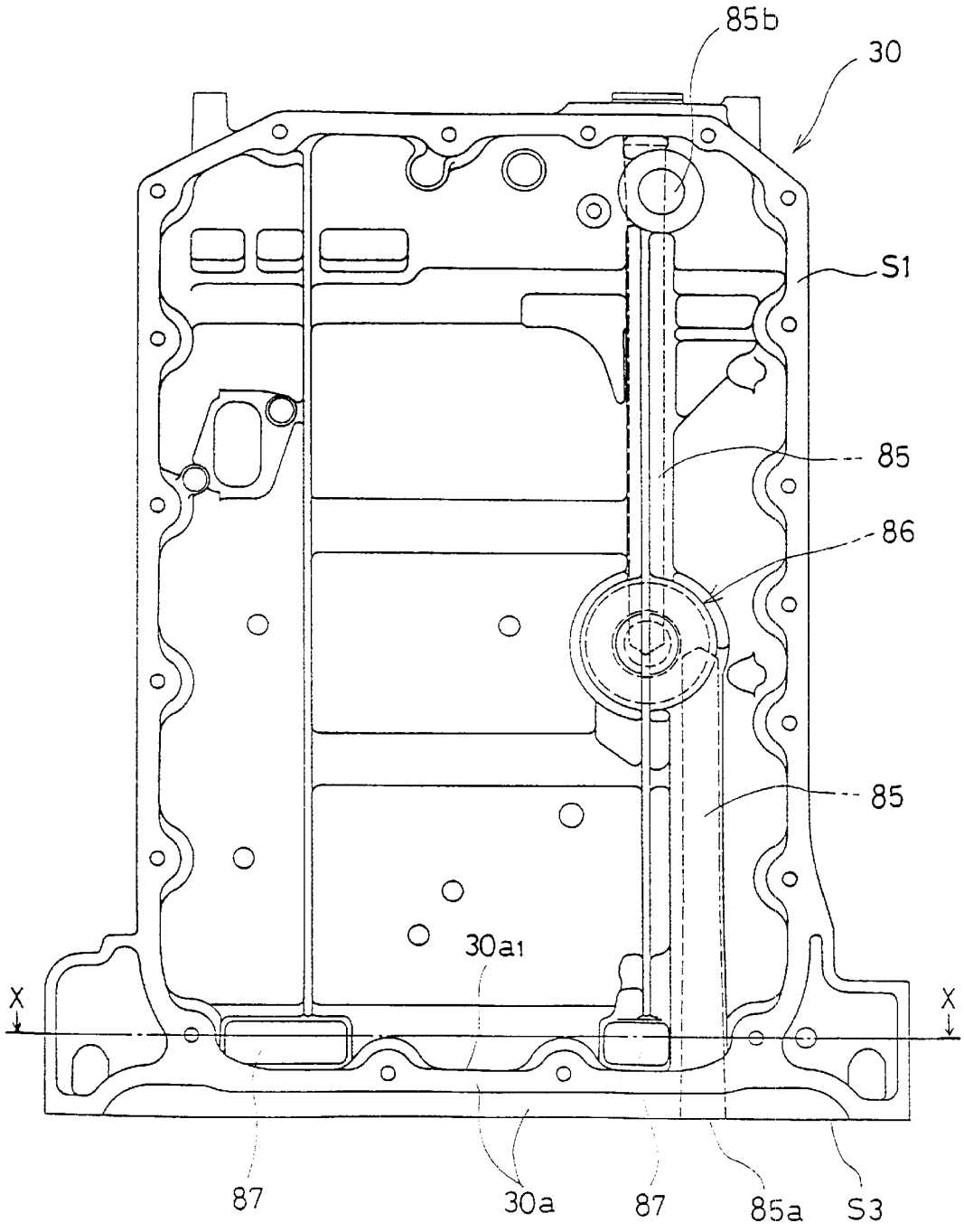
FIG. 9 is a view of the crankcase taken from its surface for contact with the cylinder head.

The engine body 3 is united to the mount case 4 through the pump body 65 with a plurality of bolts B2 (one of which is shown in FIG. 3) and supported thereby. More specifically, the engine body 3 is united to an annular support wall 64 as a support portion of the mount case 4 through the outer circumferential wall 63 as the outer circumferential portion of the pump body 65 with a number of bolts B2 applied to the coupling walls 61, 62 as coupling portions for coupling to the mount case 4. Referring below to FIGS. 3 and 8, explanation is made about these coupling walls 61, 62, outer circumferential wall 63 and support wall 64 forming the support structure of the engine body 3, and pathways formed in these portions.

Referring to FIGS. 4 and 5, lower end surfaces of the cylinder block 31 and the coupling walls 61, 62 of the crankcase 30 lie on a common plane. These lower end surfaces form fitting surfaces S3, S4 (FIG. 4) having configurations mating with the fitting surfaces S5 (FIG. 5) that is the plane defined by the upper end surface of the outer circumferential wall 63 of the pump body 65.

The coupling wall 61 of the crankcase 30 will be explained below. As shown in FIG. 4, the coupling wall 61 is made up of the left coupling wall 61*a*, right coupling wall 61*b* and front coupling wall 61*c* which form the left wall portion 60*a*, right wall portion 60*b* and front wall portion 60*c* of the circumferential wall 60, respectively. The front coupling wall 61*c* includes an inner coupling wall 61*c*1 forming the front wall portion inner wall 60*c*1 of the circumferential wall 60, and an outer coupling wall 61*c*2 positioned at a distance radially outward and forward of the inner coupling wall 61*c*1 and forming the front wall portion outer wall 60*c*2. Thus a first return oil path 71 is formed in a space 61*s* in form of a recess defined by the crank case bottom wall 30*a* as its upper wall between the inner coupling wall 61*c*1 and the outer coupling wall 61*c*2. The first return oil path 71 has a first inflow opening 71*a* and a second inflow opening 71*b* that are through holes formed in the bottom wall 30*a* of the crankcase 30. Further formed in the bottom wall 30*a* is an insertion hole 30*b* communicating with the space 61*s* and receiving the shifting shaft 20*a* having the center axis L2 on the reference plane P0 (see FIG. 3 as well). The first inflow opening 71*a* is positioned rightward of the insertion hole 30*b*, and its entirety opens at a location nearer to the reference plane P0 than the inflow opening 85*a* if the case oil path 85. The second inflow opening 71*b* is positioned leftward of the insertion hole 30*b*, and a part thereof opens at a location nearer to the reference plane P0 than the inflow opening 85*a*.

On the other hand, the coupling wall 62 of the cylinder block 31 is made up of a left coupling wall 62*a*, right coupling wall 62*b* and rear coupling wall 62*d* that form the left wall portion 60*a*, right wall portion 60*b* and rear wall portion 60*d* of the circumferential wall 60, respectively. Among them, the left coupling wall 62*a* has formed a bulging portion that bulges radially outward to form an accommodating portion 62*a*1 for accommodating a starter motor 67 having a pinion 67*a* in engagement with the ring gear 55. Additionally, the left outer circumferential wall 63*a* forming the left wall portion 60*a*, as explained later, and the left support wall 64*a* explained later have formed bulging portions 63*a*1, 64*a*1 of a shape mating with the accommodating portion 62*a*1.

The rear coupling wall 62*d* is made up of an inner coupling wall 62*d*1 forming the rear wall portion inner wall 60*d*1 of the circumferential wall 60 and an outer coupling wall 62*d*2 positioned at a distance radially outward and rearward of the inner coupling wall 62*d*1 to form the rear wall portion outer wall 60*d*2. Thus a first drainage path 76 in form of a recess having surfaces forming fitting surfaces S4 at right and left end portions that are positions intersecting with the reference plane P0 and having a pair of partition walls 62*e* is formed in a space 62*s* in form of a recess defined by the cylinder block lower wall 31a as its upper wall between the inner coupling wall 62*d*1 and the outer coupling wall 62*d*2. Leftward and rightward adjacent to the first drainage path 76, second return oil paths 72 in form of a through hole are formed. Each of the second return oil paths 72 communicates with a return passage (not shown) formed in the lower wall 31*a* of the cylinder block 31 and opening into the valve drive chamber 50. The lower wall 31*a* of the cylinder block 31 has formed a pair of inflow openings 77 making communication between the first drainage path 76 and a cooling water jacket of the cylinder block 31. K1 denotes a reinforcing rib.

The coupling walls 61, 62 have formed a plurality of bolt holes H1 opening at the fitting surfaces S3, S4 for engagement with a plurality of bolts B2 inserted into the support wall 64. Both inner coupling walls 61*c*1, 62*d*1 have formed four bolt holes H2 for engagement with four bolts for partly fixing the oil pump 58 to the coupling walls 61, 62 before the engine body 3 is united to the mount case 4.

Referring to FIG. 5, the outer circumferential wall 63 of the pump body 65 includes left outer circumferential wall 63*a*, right outer circumferential wall 63*b*, inner circumferential wall 63*c*1 and outer circumferential wall 63*c*2 of a front outer circumferential wall 63*c*, and inner circumferential wall 63*d*1 and outer circumferential wall 63*d*2 of a rear outer circumferential wall 63*d*, which corresponds, respectively, to the left coupling walls 61*a*, 62*a*, right coupling walls 61*b*, 62*b*, of the coupling walls 61, 62, inner coupling wall 61*c*1 and outer coupling wall 61*c*2 of the front coupling wall 61*c*, and inner coupling wall 61*d*1 and outer coupling wall 61*d*2 of the front coupling wall 61*d*. The left outer circumferential wall 63*a*, right outer circumferential wall 63*b*, inner circumferential wall 63*c*1 and outer circumferential wall 63c2 of the front outer circumferential wall 63, and inner circumferential wall 63d1 and outer circumferential wall 63d2 of the rear outer circumferential wall 63d form, respectively, the left wall portion 60a, right wall portion 60b, front wall portion inner wall 60c1 and front wall portion outer wall 60c2 of the front wall portion 60c, and rear wall portion inner wall 60d1 and rear wall portion outer wall 60d2 of the rear wall portion 60d. K2 denotes a reinforcing rib.

In the space 63cs defined by a through hole between the inner circumferential wall 63c1 and the outer circumferential wall 63c92 of the front outer circumferential wall 63c, a third return oil path 73 is formed as a through hole having a mating shape with the first return oil path 71. In the space 63ds defined between the inner circumferential wall 63d1 and the outer circumferential wall 63d2 of the rear outer circumferential wall 63d, a second drainage path 78 and fourth return oil paths 74 are provided in form of through holes of mating shapes with the first drainage path 76 and the second return oil paths 72.

Referring to FIG. 7(A), while the fitting surface S5 of the pump body 65 mates with the fitting surfaces S3, S4 as explained above, the lower end surface of the pump body 65 forms a fitting surface S6 of a shape mating with a fitting surface S7 that is the upper end surface of the support wall 64 of the mount case 4. The fitting surface S6 is made up of lower end surfaces of the left outer circumferential wall 63a, right outer circumferential wall 63b, outer circumferential wall 63c2 of the front outer circumferential wall 63c and outer circumferential wall 63d2 of the rear outer circumferential wall 63d, and lower end surfaces of a part of the inner circumferential wall 63d2 and right and left partition walls that define the second drainage path 78.

The left outer circumferential wall 63a, right outer circumferential wall 63b, outer circumferential wall 63c2 of the front outer circumferential wall 63c and outer circumferential wall 63d2 of the rear outer circumferential wall 63d have a plurality of through holes H3 opening to both fitting surfaces S5 and S6 to receive a plurality of bolts B2 that are inserted through the support wall 64 for engagement with bolt holes H1 of the coupling walls 61, 62. Also the both inner circumferential walls 63c1, 63d1 have four through holes H4 that receive those four bolts for partly fixing the oil pump 58.

Referring to FIGS. 5, 7(A) and 7(B), at positions inside the fitting surfaces S5 and S6 that form annularly continuous sealing surfaces of the pump body 65, there are provided a plurality of seats having protrusions on which are abutted clamps C used for fixing the pump body 65 to a jig (not shown) during the operation for grinding the fitting surfaces S5 and S6. These seats having protrusions are formed at circumferentially and substantially equally spaced locations and at radially outer positions of the flywheel chamber 59. More specifically, in this embodiment, the pump body 65 is formed with a shelve-like seat 69a, a shelve-like seat 69b and a seat 69c. The shelve-like seat 69a is formed at an end portion of the fourth return oil path 74 adjoining the left side of the second drainage path 78 in a manner to connect the inner and outer circumferential walls 63d1 and 63d2. The shelve-like seat 69b is formed at an end portion of the fourth return oil path 74 adjoining the right side of the second drainage path 78 in a manner to connect the inner and outer circumferential walls 63d1 and 63d2. The seat 69c is formed on the inner circumferential wall 63c1 in the region where the inner circumferential wall 63c1 intersects the reference plane P0. The seats 69a, 69b and 69c have upper surfaces 69a1, 69b1 and 69c1 and lower surfaces 69a2, 69b2 and 69c2, respectively. The upper surfaces 69a1, 69b1 and 69c1 are formed on the same plane as the fitting surface S5 at locations not interfering with a seal member (not shown) which is provided on the fitting surface S5, while the lower surfaces 69a2, 69b2 and 69c2 are formed to recede from the fitting surface S6. The lower surfaces 69a2, 69b2 and 69c2 of the seats 69a, 69b and 69c have protrusions 69a3, 69b3 and 69c3 formed thereon, respectively.

The fitting surfaces S5 and S6 are subjected to grinding operation as follows. First, the pump body 65 is fixedly held to a jig by making use of the hole 65a of the pump body 65, and the fitting surface S5 is formed on the pump body 65 by grinding. Thereafter, the pump body 65 is loosened and inverted and then fixedly held to the jig again by tightening the clamp C which is in abutment with the protrusions 69a3, 69b3 and 69c3. Then, the fitting surface S6 and the surface to which the pump cover 66 is liquid-tightly joined is formed by grinding operation.

Next referring to FIG. 8, the mount case 4 has the support wall 64 that projects upward such that the coupling walls 61, 62 are united there to together with the outer circumferential wall 63 with a plurality of bolts B2 while the outer circumferential wall 63 of the pump body 65 is sandwiched between the coupling walls 61, 62. When those bolts B2 are fixed, the fitting surfaces S3, S4 liquid-tightly contact with the fitting surface S5, and the fitting surface S6 with the fitting surface S7. Therefore, the fitting surfaces S3 through S7 serve as sealing surfaces. The support wall 64 includes an annular outer support wall made up of a left support wall 64a, right support wall 64b, front support wall 64c and outer wall 64d2 of the rear support wall 64d that correspond respectively to the left outer circumferential wall 63a, right outer circumferential wall 63d, outer circumferential wall 63c2 of the front outer circumferential wall 63c and outer circumferential wall 63d2 of the rear outer circumferential wall 63d, and includes an inner wall 64d1 of the rear support wall 64d and a partition wall 64e that correspond, respectively, to a part of the inner circumferential wall 63d1 and the partition wall 63e defining the second drainage path 78. The outer support wall and the inner wall 64d1 have a plurality of through holes H5 for receiving a plurality of bolts B2 applied through the support wall 64.

Since the mount case 4 having the above-explained support wall 64 supports the engine body 3 by means of the coupling walls 61, 62, the pump body 65 is integrally united to the mount case 4 together with the engine body 3 by applying a plurality of bolts B2 inserted through the through holes H5, H3 made in the support wall 64 and the outer circumferential wall 63 and fixing them into the bolt holes H1 made in the coupling walls 61, 62 while the outer circumferential wall 63 of the pump body 65 is sandwiched between the coupling walls 61, 62, and the support wall 64, and while the left coupling walls 61a, 62a of the coupling walls 61, 62, right coupling walls 61b, 62b, both outer coupling walls 61c2, 62d2, left outer circumferential wall 63a of the outer circumferential wall 63, right outer circumferential wall 63b, both outer circumferential walls 63c2, 63d2 and the outer support wall of the support wall 64 overlap substantially entirely in the rotation axis direction. The support wall 64 of the mount case 4, outer circumferential wall 63 and coupling walls 61, 62 of the pump body 65 make up the coupling portion for coupling the engine body 3 to the mount case 4 through the pump body 65, and the outer diameter of the support wall 64, throughout its entire circumference including the outer diameter in the right and left direction, is substantially equal to the outer diameter of the coupling walls 61, 62 and the outer circumferential wall 63 making up the circumferential wall 60 of the flywheel chamber 59. Therefore, the outer diameter of the circumferential wall 60 in the right and left direction is regulated by the left coupling walls 61*a*, 62*a* and the left outer circumferential wall 63*a*, and by the right coupling walls 61*b*, 62*b* and the right outer circumferential wall 63*b*, whereas the outer diameter of the circumferential wall 60 in the front and rear direction is regulated by the outer coupling wall 61*c*2 of the front coupling wall 61*c* and the outer circumferential wall 63*c*2 of the front outer circumferential wall 63*c* and by the outer coupling wall 62*d*2 of the rear coupling wall 62*d* and the outer circumferential wall 63*d*2 of the rear outer circumferential wall 63*d*.

The mount case 4 also has a third drainage path 79 in form of a recess of a shape corresponding to the second drainage path 78, and at right and left end portions thereof, a pair of drainage holes 80 are provided to communicate with a drainage tube (not shown) connected to the lower surface of the mount case 4. Then an accommodating chamber 81 is provided in front of the third drainage path 79 to accommodate mount rubber R1 that permits a stud bolt B1 for uniting the swivel shaft 14 and the mount case 4 to pass through, and a fifth return oil path 75 in form of a through hole is provided between the accommodating chamber 81 and the third drainage path 79 to permit the lubricant oil to drop into the oil pan 5. At the portion of the fifth return oil path 75 intersecting with the reference plane P0, the oil suction tube 23 (see FIG. 2) is inserted. Coupling of the support wall 64 and the pump body 65 results in defining a return oil collection chamber 82 having the pump body 65 and the pump cover 66 as its upper wall and having the mount case 4 as its lower wall. Inside the collection chamber 82, the upper surface of the mount case 4 has formed holes 84*a*, 84*b* surrounded by the support wall 64 and allowing the drive shaft 11 and the shifting shaft 20*a* to pass through liquid-tightly. The upper surface of the mount case 4 inside the collection chamber 82 serves as a guide surface 83 that receives lubricant oil dropping from the first and third return oil paths 71, 73 and guiding it into the fifth return oil path 75. Further, most of the lubricant oil dropping from the second and fourth return oil paths 72, 74 drops into the oil pan 5 from the right side end of the fifth return oil path 75.

Behind the support wall 64, a pair of exhaust pipes 54 are provided to be connected to the exhaust manifold 53 of both banks of the cylinder block 31, and cooling water from the cooling water supply pipe 24 (see FIG. 2), through which cooling water pumped out from a water pump, not shown, travels, is supplied from the cooling water path running above the oil pan 5 through the path around the exhaust pipe 54 and through the joint 85 to the cooling water jacket of the cylinder block 31 and the cylinder head 32.

In this fashion, the support wall 64 of the mount case 4 is united to the coupling walls 61, 62, to which the outer circumferential wall 63 of the pump body 65 forming the flywheel chamber 59 is united, via the outer circumferential wall 63 with bolts B2, and thereby supports the engine body 3. Therefore, the coupling walls 61, 62, outer circumferential wall 63 and the support wall 64 are aligned with the first plane P1 and the second plane P2, and the left coupling walls 61*a*, 62*a* and the right coupling walls 61*b*, 62*b* of the cylinder block 31 and the crankcase 30, and all of the left outer circumferential walls 63 and the right outer circumferential wall 63*b* of the outer circumferential wall 63 of the pump body 65, and the left support wall 64*a* and the right support wall 64*b* of the support wall 64 form a single wall substantially uniform in outer diameter in the right and left direction. As a result, the outer diameter of the coupling walls 61, 62, outer circumferential wall 63 and support wall 64 in the right and left direction can be minimized within the range sufficient for the circumferential wall 60 to accommodate the flywheel 56. Responsively, in accordance with the outer diameter of the single wall in the right and left direction, the undercover 7 covering it from radially outside and the engine cover 8 united to the undercover 7 can be decreased in dimension in the right and left direction.

Next, the lubricating system will be described with reference to FIGS. 2 and 9 through 11. The case oil path 85 introducing lubricant oil released from the release port 58*e* (FIG. 6) of the oil pump 58 extends vertically in a right half portion of the crankcase 30, and the outflow opening 85*b* at the upper end thereof communicates with a cover oil path (not shown) made in the upper seal cover 34. In a midway of the case oil path 85, an oil filter 86 (see FIG. 2) attached to the front face of the crankcase 30 forming the front portion of the engine body 3 is located such that lubricant oil introduced from the inflow opening 85*a* and freed from foreign matters by the oil filter 86 flows toward the outflow opening 85*b*.

The cover oil path, explained above, communicates with a block oil path (not shown) forming the main gallery provided at the portion forming the V-shaped valley portion of the cylinder block 31, and the block oil path communicates with a head oil path (not shown) formed in the cylinder head 32. Thus the lubricant oil in the block oil path is supplied to four journal portions of the crankshaft 36, and a part of lubricant oil supplied from the journal portion is supplied to, among others, the coupling portion between the crank pin and the large end portion of the connection rod 43 via an oil hole made inside the crankshaft 36 to lubricate sliding portions of the crankshaft 36 and other sliding portions of members existing inside the crank chamber 37. At the same time, it is supplied to sliding portions of the valve driving mechanism V in the valve drive chamber 50 via the head oil path and lubricates the siding portions.

Therefore, the case oil path 85, cover oil path, block oil path and head oil path make up the supply oil path for supplying lubricant oil released from the oil pump 58 to various portions of the engine body 3 to be lubricated, such as those sliding portions, for example, and among them, the case oil path 85 formed in the crankcase 30 forming the front portion of the engine body 3 makes up the front supply oil path.

Figure 10:
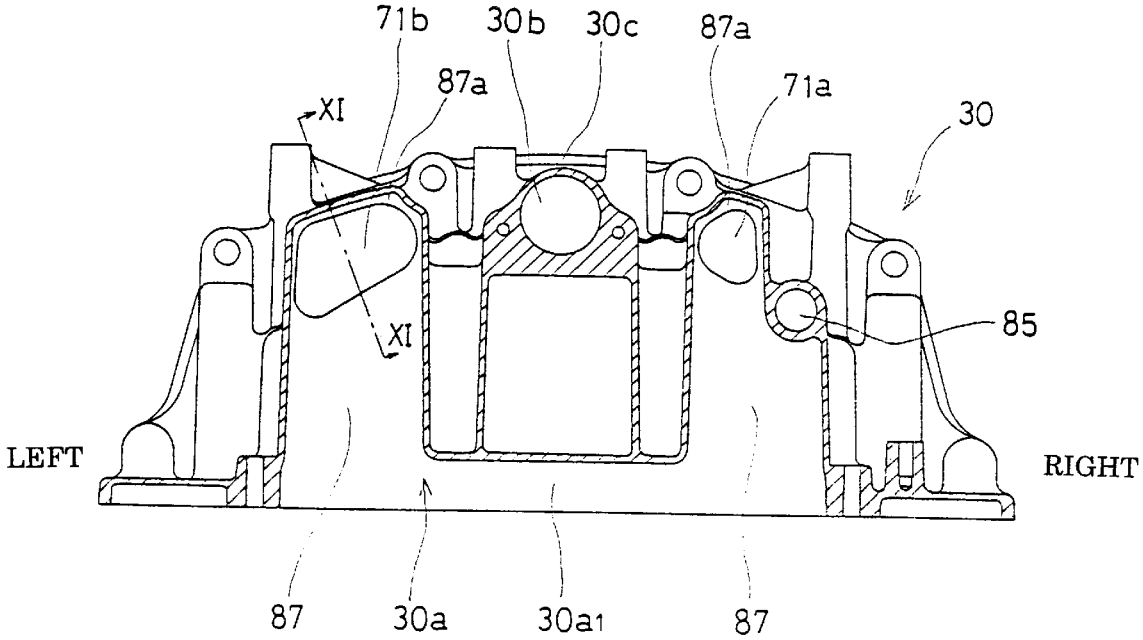
FIG. 10 is cross-sectional view taken along the X—X line of FIG. 9.
Figure 11:
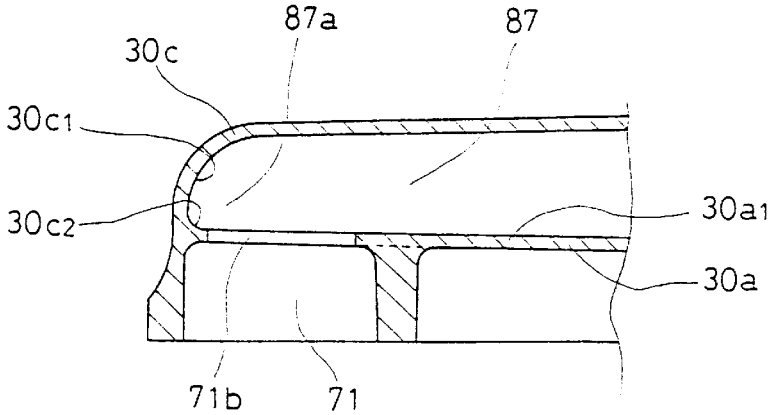
FIG. 11 is a cross-sectional view taken along the XI—XI line of FIG. 10.

The lubricant oil after lubricating sliding portions inside the crank chamber 37 drop on the upper surface of the lower seal cover and the upper surface of the bottom wall 30*a* (FIG. 3) of the crankcase 30. A part of the lubricant after lubricating sliding portions inside the valve drive chamber 50 flows into the crank chamber 37 via the return oil path made in the cylinder block 31 and a plurality of breather paths (not shown) and drops onto the upper surface of the lower seal cover 35. As shown in FIGS. 10 and 11, the lubricant oil flowing down or dropping onto the upper surface of the lower seal cover 35 and the upper surface of the bottom wall 30*a* of the crankcase 30 then drops onto the guide surface 83 (FIG. 8) through the return oil path made up of the first return oil path 71 having the first and second inflow openings 71*a*, 71*b* opening at the bottom wall 30*a* and the third return oil path 73 (FIG. 3) of the outer circumferential wall 63, and thereafter drops into the oil pan 5 through the fifth oil path 75 of the mount case 4.

As best shown in FIG. 11, the first and second inflow openings 71*a*, 71*b* are made in the bottom wall 30*a* in proximity of a rising start end 30*c*2 of the front wall 30*c* having an inner wall surface 30*c*1 that rises from the upper surface 30*a*1 of the bottom wall 60*a* in the front-most portion 87*a* of a projection space 87 defined by the upper surface 30*a*1 of the bottom wall 30*a* of the crankcase 30 and the inner wall surface 30*c*1 of the front wall 30*c* to project forward. The proximity of the rising start portion 30*c*2 herein means positions of the first and second inflow openings 71*a*, 71*b* providing a distance enough to prevent lubricant oil from staying between the first and second inflow openings 71, 71*b* and the rising start portion 30*c*2, whichever the rising start portion 30*c*2 partly forms the openings of the first and second inflow openings 71*a*, 71*b*, or not.

In this manner, since the first and second inflow openings 71*a*, 71*b* make up the front-most portion 87*a* of the projection space 87 and are located in proximity of the rising start portion 30*c*2, even when the engine body 3 inclines forward during operation under a condition where the outboard engine 1 is tilted up, such as during cruising of the boat in shallow water, almost all of the lubricant oil flowing on the bottom wall 30*a* can flow into the first and second inflow openings 71*a*, 71*b* without staying on the bottom wall 30*a*, then can drop onto the guide surface 83 from the first return oil path 71 through the third return oil path 73 of the outer circumferential wall 63, and can drop into the oil pan 5 through the fifth return oil path 75.

On the other hand, lubricant oil from the valve drive chamber 50 flows through a rear return oil path made up of the second return oil paths 72 (FIG. 4) and the fourth return oil paths 74 (FIG. 7A) and through the fifth return oil path 75 (FIG. 8), and drops into the oil pan 5. Part of the lubricant oil already lubricating sliding portions inside the valve drive chamber 50, other than the part flowing out to the crank chamber 37, runs through the return tube 25 (see FIG. 2) attached to the head cover 33 and drops into the oil pan 5. Therefore, the first to fifth return oil paths 71 through 75, return passage and return tube 25 make up a return oil path that guides the lubricant oil supplied to those portions to be lubricated back to the oil pan 5.

Next, operation and effects of the embodiment having the above-explained configuration will be explained.

The left coupling walls 61*a*, 62*a*, right coupling walls 61*b*, 62*b* and outer coupling walls 61*c*2, 62*d*2 of the coupling walls 61, 62, left outer circumferential wall 63*a*, right outer circumferential wall 63*b*, outer circumferential wall 63*c*2 and outer circumferential wall 63*d*2 of the outer circumferential wall 6*e*, and outer support wall of the support wall 64 are united together so as to overlap substantially entirely in the rotation axis direction. Therefore, it is not necessary to make the coupling walls and the support wall as surrounding the outer circumference of the pump body 65. This contributes to minimizing the diameter of the coupling walls 61, 62, outer circumferential wall 63 and support wall 64, which are coupling portions of the engine body 3 and the mount case 4; within a range sufficient for the pump body 65 forming the circumferential wall 60 of the flywheel chamber 59 to accommodate the flywheel 56, and hence contributes to reducing the size and weight of the outboard engine 1.

In addition to that, since the outer circumferential wall 63 of the pump body 65 is disposed to overlap the coupling walls 61, 62 and the support wall 64 in the rotation axis direction as explained above, regardless of the coupling walls 611, 62 being united to and supported by the support wall 64 via the pump body 65, weight of the engine 2 acting upon the outer circumferential wall 63 via the coupling walls 61, 62 is withheld by the support wall 64 of the mount case 4 via the outer circumferential wall 63, and it is prevented that a bending moment caused by the weight acts on the pump body 65. As a result, the pump body 65 is prevented from being deformed by such a bending moment caused by the weight, and the pump body 65 need not be increased in rigidity for the purpose of preventing such deformation. Thus, also in this respect, the pump body 65 can be reduced in weight, and the outboard engine 1 can be decreased in weight as well.

The left wall portion 60*a* and the right wall portion 60*b* forming a part of the circumferential wall 60 of the flywheel chamber 59, which is made up of the outer circumferential wall 63 and the coupling walls 61, 62 is made up of a single wall portion, i.e. a single-layered wall in the radial direction of the flywheel 56, and at the same time, outer diameter of the coupling walls 61, 62 forming the circumferential wall 60, of course, and of the support wall 64 in the right and left direction is substantially equal to the outer diameter of the circumferential wall 60 in the right left direction defined by the left wall portion 60*a* and the right wall portion 60*b*. Therefore, it is possible to minimize the outer diameter of the coupling walls 61, 62, outer circumferential wall 63 and support wall 64 in the right and left direction within a range sufficient for the pump body 65 forming the flywheel chamber 59 to accommodate the flywheel 56. As a result, during right and left rotation of the outboard engine 1 about the swivel shaft 14, the under cover 7 and other members are prevented from interfering with external members in the right left direction of the coupling portions, which contributes to reducing the sizes of the under cover 7 covering the coupling portions, and the engine cover 8 in the right and left direction, preventing the undercover 7 and other members from interfering with external members in the right and left direction of the coupling portions during right and left rotation of the outboard engine 1 about the swivel shaft 14, increasing the steering angle, and improving the maneuverability. Moreover, also in case of a double engine construction in which outboard engines are fixed in parallel to a boat stern, it is possible to prevent those outboard engines from interfering with each other near that portion and to provide a large steering angle.

The front wall portion 60*c* and the rear wall portion 60*d* of the circumferential wall 60 of the flywheel chamber 59 made up of the outer circumferential wall 63 and the coupling walls 61, 62 are in form of double-wall portions, i.e. double walls distant in the radial direction of the flywheel 56, outer circumferential wall 63. At the same time, outer diameter of the coupling walls 61, 62 forming the circumferential wall 60, of course, and of the support wall 64, in the right and left direction, is substantially equal to the outer diameter of the circumferential wall 60 in the front and rear direction as regulated by the front wall portion 60*c* and the rear wall portion 60*d*. Therefore, regardless of the outer diameter of the support wall 64 in the right and left direction being small, the support strength is improved, thereby to ensure sufficient support strength of the engine body 3, increase the region of the engine body 3 supported by the support wall 64, which makes it possible to support the engine body 3 more reliably.

Lubricant oil present in the crank chamber 37 after lubricating portions of the engine 2 to be lubricated flows down or drops onto the bottom wall 30*a* of the crankcase 30 and the upper surface of the lower seal cover 35, then flows along the upper surface 30*a*1 of the bottom wall 30*a* forming the upper wall 59*b* of the flywheel chamber 59, or flows first along the upper surface of the lower seal cover 35 and then along the bottom wall 30*a*, and flows into the first return oil path 71 from the first and second inflow openings 71*a*, 71*b*, exiting from the crank chamber 37, until finally returning back to the oil pan 5 through the third and fifth return oil paths 73, 75. Thus, during operation under a condition where the outboard engine 1 is tilted up, such as during cruising of the boat in shallow water, the lubricant oil flowing on the bottom wall 30*a* inclined down frontward flows into the first return oil path 71 having the first and second inflow openings 71*a*, 71*b* located forward of the inner circumferential wall 60*c* of the flywheel chamber 59. As a result, during operation under a tilt-up condition, it is ensured that substantially no or only minimum lubricant oil stays on the bottom wall 30*a*. Therefore, unlike the conventional techniques, there is no need of increasing the quantity of lubricant oil retained in the oil pan 5, which will be required to be larger in capacity, taking account of the quantity of lubricant oil that will stay in the crank chamber 37. Accordingly, the oil pan 5 can be decreased in size and weight, and the outboard engine 1 can be decreased in size and weight as well. Further, since it is substantially prevented that the crankshaft 36 stirs lubricant oil staying in the crank chamber 37, output loss by agitation of lubricant oil can be prevented. Furthermore, since substantially no or only an extremely small amount of lubricant oil stays in the crank chamber 37, the first return oil path 71 and the third return oil path 73, as well as the first and second inflow openings 71*a*, 71*b*, need not be increased in diameter for the purpose of ensuring smooth outflow of lubricant oil from the crank chamber 37 including the lubricant oil having stayed there, immediately after the tilt-up condition is canceled, the first and third return oil paths 71, 73 including the first and second inflow openings 71*a*, 71*b* can be decreased in diameter in comparison to those of the conventional techniques, and the outboard engine 1 can be made compact and lightweight so much.

The left wall portion 60*a* and the right wall portion 60*b* forming a part of the circumferential wall 60 of the flywheel chamber 59 are made up of single wall portions, i.e. single-layered walls in the radial direction of the flywheel 56. Therefore, outer diameter of the flywheel chamber 59 decreases in the right and left direction, and accordingly, the outboard engine 1 decreases in width in the right and left direction, thereby contributing to making the outboard engine 1 compact and increasing the freedom of location thereof on the boat stern T. Furthermore, since the first and third return oil paths 71, 73 are made by making use of the spaces 61*s*, 63*cs* between the front wall portion inner wall 60*c*1 and the front wall portion outer wall 60*c*2 of the circumferential wall 60 of the flywheel chamber 59, it is prevented that the bottom wall 30*a* of the crankcase 30 becomes excessively large in the front and rear direction to make the first and third return oil paths 71, 73, and the outboard engine 1 can be reduced in size and weight.

The first and second inflow openings 71*a*, 71*b* formed in the bottom wall 30*a* of the crankcase 30, which is located in front of the cylinder block 31 to make up the front portion of the engine body 3, open in proximity of the rising start portion 30*c*2 of the front-most portion 87*a* of the projection space 87. Therefore, when the outboard engine 1 is driven under a tilt-up condition, lubricant oil flowing on the bottom wall 30*a* inclining down forward flows toward the front-most portion 87*a* that is positioned in the lowest level, and flows into the first and second inflow openings 71*a*, 71*b* formed in proximity of the rising start portion 30*c*2 of the front wall 30*c*. As a result, substantially no or only an extremely small quantity of lubricant oil stays in the crank chamber 37, and the effect of the embodiment is further enhanced in compact and light weight design of the outboard engine 1 and prevention of output loss.

In the bottom wall 30*a* of the crankcase 30, the first and second inflow openings 71*a*, 71*b* are provided at locations in proximity of the reference plane P0 that is the center plane of the crankcase 30 in the right and left direction, without any restriction from the case oil path 85 formed in the bottom wall 30*a* of the crankcase 30. Therefore, the first and second inflow openings 71*a*, 71*b* are disposed at positions of the bottom wall 30*a* of the crankcase 30 near the reference plane P0, where lubricant oil from peripheral portions distant from the reference plane P0 is most likely to gather, that is, at optimum positions for the first and second inflow openings 71*a*, 71*b*.

Outer diameter of the coupling portions from the support wall 64 of the mount case 4 to the outer circumferential wall 63 of the pump body 65 and coupling walls 61, 62 of the crankcase 30 and the cylinder block 31 collectively is substantially equal to the outer diameter of the circumferential wall 60 of the flywheel chamber 59. Therefore, in the outboard engine 1 in which the engine body 3 is united to the mount case 4 through the pump body 65, the outer diameter of the coupling portions can be minimized within a range sufficient for the circumferential wall 60 to accommodate the flywheel 56, and the outboard engine 1 can be further reduced in size and weight.

Since the seats 69*a*, 69*b* and 69*c* are provided inside the fitting surfaces S5 and S6 of the pump body 65, that is, radially inward of the pump body 65, to support the jig for fixing the pump body 65 during the machining of the pump body 65, layout of parts and auxiliary machineries disposed radially outside of the pump body 65 is not limited by the seats 69*a*, 69*b* and 69*c*, so that the freedom of layout of the parts and auxiliary machineries is enlarged.

Explanation will be made below about embodiments partly modified from the foregoing embodiment, focusing at modified configurations.

The upper wall 59*b* of the flywheel chamber 59 can be made only of members forming the bottom wall of the crank chamber, or may be made of a cylinder block and a crankcase not having skirt portions.

The foregoing embodiment has been explained as the coupling portion being made up of the coupling walls 61, 62 in form of projecting walls of the cylinder block and the crankcase; however, the coupling portion need not project.

Although the foregoing embodiment has been explained as the engine 2 being a V-type cylinder engine, it may be a serially aligned multi-cylinder engine.

Although there has been described what is the present embodiment of the invention, it will be understood by persons skilled in the art that variations and modifications may be made thereto without departing from the gist, spirit or essence of the invention.

What is claimed is:

1. An outboard engine including: an engine having an engine body, a crankshaft extending vertically in the engine body, a flywheel provided on the crankshaft below the engine body, an oil pump driven by a driving power of the crankshaft, and a flywheel chamber defined by a pump body of the oil pump to accommodate the flywheel; and a mount case having a support portion for uniting the engine body, wherein:

said engine body is united with a coupling portion thereof to said support portion via an outer circumferential portion of said pump body such that said coupling portion, said outer circumferential portion of the pump body and said support portion overlap in the direction of extension of a rotating axis of said crankshaft.

2. An outboard engine according to claim 1, further including a mounting device having a swivel shaft for mounting to a boat stern, said outer circumferential portion forming a circumferential wall of said flywheel chamber, said circumferential wall includes single-wall portions, a left wall portion and a right wall portion of said circumferential wall being made of said single-wall portions, and outer diameters of said coupling portion and said support portion in the right and left direction being substantially equal to the outer diameter of said circumferential wall in the left and right direction as regulated by said left wall portion and said right wall portion.

3. An outboard engine including: an engine having an engine body, a crankshaft extending vertically in the engine body, a flywheel provided on the crankshaft below the engine body, an oil pump driven by a driving power of the crankshaft, and a flywheel chamber defined by a pump body of the oil pump to accommodate the flywheel; and a mount case having a support portion for uniting the engine body, wherein:

said engine body is united with a coupling portion thereof to said support portion via an outer circumferential portion of said pump body such that said coupling portion, said outer circumferential portion of the pump body and said support portion overlap in the direction of extension of a rotating axis of said crankshaft; and said circumferential wall further includes double-wall portions, a front wall portion and a rear wall portion of said circumferential wall being made of said double-wall portions, outer diameters of said coupling portion and said support portion in the front and rear direction being substantially equal to the outer diameter of said circumferential wall in the front and rear direction as regulated by said front wall portion and said rear wall portion.

4. An outboard engine including: an engine having an engine body, a crankshaft extending vertically in the engine body, a flywheel provided on the crankshaft below the engine body, an oil pump driven by the crankshaft, and a flywheel chamber defined under said engine body between the engine body and a pump body of the oil pump which is coupled to a bottom of the engine body to accommodate the flywheel; and a mount case having a substantially annular upstanding support wall on an upper surface thereof, said support wall uniting the engine body to the mount case, wherein:

said pump body is in the form of a pump housing and has an outer circumferential wall and said engine body has a substantially annular coupling wall projecting downwardly from the bottom of the engine body, said engine body being united with said upstanding support wall via said outer circumferential wall of said pump body such that said coupling wall, said outer circumferential wall of the pump body and said support wall overlap in the direction of extension of a rotating axis of said crankshaft.

5. An outboard engine according to claim 4, wherein said outboard engine mounts to a boat stern by a mounting device having a swivel shaft, said outer circumferential wall of the pump body having single-wall portions and other wall portions, said circumferential wall including a left wall portion and a right wall portion which form said single-wall portions, said coupling wall and said support wall having outer diameters, in the right and left direction of the engine, which are substantially equal to outer diameters of said circumferential wall in the left and right direction as regulated by said left wall portion and said right wall portion.

6. An outboard engine according to claim 5, wherein said other wall portions of said circumferential wall of the pump body includes double-wall portions, said other wall portions including a front wall portion and a rear wall portion that form said double-wall portions, said coupling wall and said support wall having outer diameters, in the front and rear direction of the engine, which are substantially equal to outer diameters of said circumferential wall in the front and rear direction as regulated by said front wall portion and said rear wall portion.

7. An outboard engine according to claim 6, wherein said double-wall portions of the pump body are formed therein with return oil paths for lubricant oil.

8. An outboard engine according to claim 4, wherein said outboard engine mounts to a boat stern by a mounting device having a swivel shaft, said outer circumferential wall of the pump body having single-wall portions and double-wall portions, said coupling wall including left and right wall portions, that form said single-wall portions, and front and rear wall portions, that form said double-wall portions.

9. An outboard engine according to claim 8, wherein said double-wall portions of the coupling wall of the pump body are formed therein with return oil paths for lubricant oil.

10. An outboard engine according to claim 4, wherein said outboard engine mounts to a boat stern by a mounting device having a swivel shaft and said engine body includes a bottom wall having inflow openings for return oil, said inflow openings being provided at foremost positions of the engine body.

* * * * *

UNITED STATES PATENT AND TRADEMARK OFFICE

CERTIFICATE OF CORRECTION

PATENT NO. : 6,484,685 B2 
DATED : November 26, 2002
INVENTOR(S) : Tatsuya Kuroda et al.

It is certified that error appears in the above-identified patent and that said Letters Patent is hereby corrected as shown below:

Column 1,
Line 14, change “amount” to -- a mount --.
Line 15, change “out board” to -- outboard --.
Line 20, change “apart” to -- a part --; change “amount” to -- a mount --; change “fly wheel” to -- flywheel --.
Line 21, change “provide data” to -- provided at a --.
Line 24, after “oil” delete the period.
Line 53, change “amount” to -- a mount --.

Column 3,
Line 66, after “is” insert -- a --.

Column 4,
Line 36, before “includes” insert -- F --.
Line 44, change “fixed’secured” to -- fixed secured --.
Line 50, change “right end left” to -- right and left --.

Column 5,
Line 7, change “31 caligned” to -- 31*c* aligned --.
Line 53, change “the those” to -- those --.
Line 60, after “36” insert a period --.

Column 8,
Line 6, change “if” to -- in --.

Column 9,
Line 12, change “63*c*92” to -- 63*c*2 --.

Column 10,
Line 21, change “there to” to -- thereto --.

Column 11,
Line 62, change “walls 63” to -- wall 63*a* --.

Column 12,
Line 37, change “siding” to -- sliding --.

UNITED STATES PATENT AND TRADEMARK OFFICE

CERTIFICATE OF CORRECTION

PATENT NO. : 6,484,685 B2
DATED : November 26, 2002
INVENTOR(S) : Tatsuya Kuroda et al.

It is certified that error appears in the above-identified patent and that said Letters Patent is hereby corrected as shown below:

Column 13,
Line 10, change "71, 71*b*" to -- 71*a*, 71*b* --.
Line 11, change "whichever" to -- whether --.
Line 48, change "6*e*" to -- 63 --.
Line 56, change "4;" to -- 4, --.
Line 65, change "611" to -- 61 --.

Column 14,
Lines 20 and 30, change "right left" to -- right and left --.

Column 18,
Line 47, after "shaft" insert a comma.

Signed and Sealed this

Eighteenth Day of March, 2003

JAMES E. ROGAN
*Director of the United States Patent and Trademark Office*